US007354343B2

(12) United States Patent
Schugar et al.

(10) Patent No.: US 7,354,343 B2
(45) Date of Patent: Apr. 8, 2008

(54) WAGERING GAME WHERE PLAYER CAN BORROW MONEY FOR WAGERS BASED ON EQUITY POSITION

(76) Inventors: David Schugar, 1685 Cedar Lake Cir., Hernando, MS (US) 38632; Jon Muskin, 4450 S. Park Ave., Chevy Chase, MD (US) 20815

( * ) Notice: Subject to any disclaimer, the term of this patent is extended or adjusted under 35 U.S.C. 154(b) by 266 days.

(21) Appl. No.: 10/874,558

(22) Filed: Jun. 24, 2004

(65) Prior Publication Data

US 2005/0085288 A1 Apr. 21, 2005

Related U.S. Application Data

(63) Continuation-in-part of application No. 10/688,898, filed on Oct. 21, 2003, now Pat. No. 7,163,458.

(60) Provisional application No. 60/548,481, filed on Feb. 26, 2004.

(51) Int. Cl.
*A63F 9/24* (2006.01)
*A63F 13/00* (2006.01)

(52) U.S. Cl. ..... 463/16; 463/10; 463/21; 463/25

(58) Field of Classification Search ..... 273/274, 273/309; 463/10, 16, 21, 25
See application file for complete search history.

(56) References Cited

U.S. PATENT DOCUMENTS

| | | | | |
|---|---|---|---|---|
| 4,042,245 | A * | 8/1977 | Zarour | 273/249 |
| 4,119,321 | A * | 10/1978 | Creel | 273/248 |
| 4,334,685 | A * | 6/1982 | Robbins et al. | 273/274 |
| 4,887,819 | A * | 12/1989 | Walker | 273/256 |
| 5,114,151 | A * | 5/1992 | Bergerstock | 273/246 |
| 5,839,725 | A * | 11/1998 | Conway | 273/244 |
| 5,964,463 | A * | 10/1999 | Moore, Jr. | 273/274 |
| 6,309,307 | B1 * | 10/2001 | Krause et al. | 473/274 |
| 6,336,633 | B1 * | 1/2002 | Webb | 273/274 |
| 6,435,505 | B1 * | 8/2002 | Hoffman | 273/274 |
| 6,464,225 | B1 * | 10/2002 | Webb | 273/274 |
| 6,601,848 | B1 * | 8/2003 | Timmons, Sr. | 273/146 |
| 6,761,353 | B2 * | 7/2004 | Berman et al. | 273/143 R |
| 6,896,264 | B1 * | 5/2005 | Haber | 273/274 |
| 2004/0124584 | A1 * | 7/2004 | Ioannis | 273/287 |

(Continued)

FOREIGN PATENT DOCUMENTS

| | | | |
|---|---|---|---|
| GB | 2133992 | * | 1/1983 |
| WO | WO 99/66998 | | 12/1999 |

OTHER PUBLICATIONS

Examination Report under Section 18(3) in UK Patent Office, issued Sep. 29, 2006.

(Continued)

*Primary Examiner*—Robert Pezzuto
*Assistant Examiner*—Sunit Pandya
(74) *Attorney, Agent, or Firm*—Muskin & Cusick LLC

(57) ABSTRACT

A method, apparatus, and computer readable storage medium for implementing a casino wagering game. The game allows the player to borrow funds against equity earned in a game currently in progress. When the game is over, any borrowed funds can be paid with winnings from the game.

29 Claims, 2 Drawing Sheets

U.S. PATENT DOCUMENTS

| | | | | |
|---|---|---|---|---|
| 2004/0195764 | A1* | 10/2004 | Cacas | 273/146 |
| 2004/0237118 | A1* | 11/2004 | Millerschone | 725/133 |
| 2004/0251626 | A1* | 12/2004 | Porter et al. | 273/146 |
| 2005/0082757 | A1* | 4/2005 | Cohen | 273/274 |

OTHER PUBLICATIONS

Heave Ho!.
Footsteps.
Quadrangle.
Stockrush!.
Author Unknown, "Blackjack Rules" http://web.archive.org/web/20031026005126/http://www.blackjackinfo.com/blackjack-rules.php#3.5 appeared on the Internet Oct. 26, 2003 or earlier.
UK Patent Office, office action in counterpart application in the UK, GB0618400.6, office action dated Mar. 14, 2007.

* cited by examiner

WAGERING GAME WHERE PLAYER CAN BORROW MONEY FOR WAGERS BASED ON EQUITY POSITION

CROSS REFERENCE TO RELATED APPLICATIONS

This patent application claims priority to the provisional patent application entitled, "Wagering Game Where Player Can Borrow Money Based on Positive Expectation," filed on Feb. 26, 2004, Ser. No. 60/548,481, which is incorporated by reference herein. This Application is also Continuation in Part (CIP) of patent application Ser. No. 10/688,898, filed on Oct. 21, 2003, entitled, "A Casino Game for Betting on a Bidirectional Linear Progression," now U.S. Pat. No. 7,163,458, which is incorporated by reference herein.

BACKGROUND OF THE INVENTION

1. Field of the Invention

The present invention is directed to a method, device, and computer readable storage medium for implementing a gambling game, wherein the house can offer a player to borrow funds before the game is over upon certain circumstances.

2. Description of the Related Art

Casino gambling games are profitable for a casino and fun for the player. Typically, a player is limited to betting with immediate liquid funds that the player currently has (i.e. cash, chips, etc.)

What is needed is a system and method wherein the player can bet in excess of the funds the player currently has.

SUMMARY OF THE INVENTION

It is an aspect of the present invention to provide improvements and innovations in gambling games, which can increase player enjoyment and casino profitability. The above aspects can be obtained by a method that includes (a) beginning a wagering game from an initial position; (b) changing the position to an advanced position based on a random outcome; (c) receiving a wager from the player; and (d) offering the player an option to borrow money from the house for the wager, if the position of the game reflects a positive expectation for the player.

Opportunities to hedge one's wager already exists in the gaming world. For example, in the game of blackjack, a player can take insurance (if the dealer's up-card is an ace) when the player has blackjack in order to guarantee that the player will receive a win. In this situation, the player can choose to take "even money" which means the player wins even money automatically without the player having to put up any additional money. In craps, a player can play the "don't pass" line and after a point has been established then the player can place an additional wager on a point.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
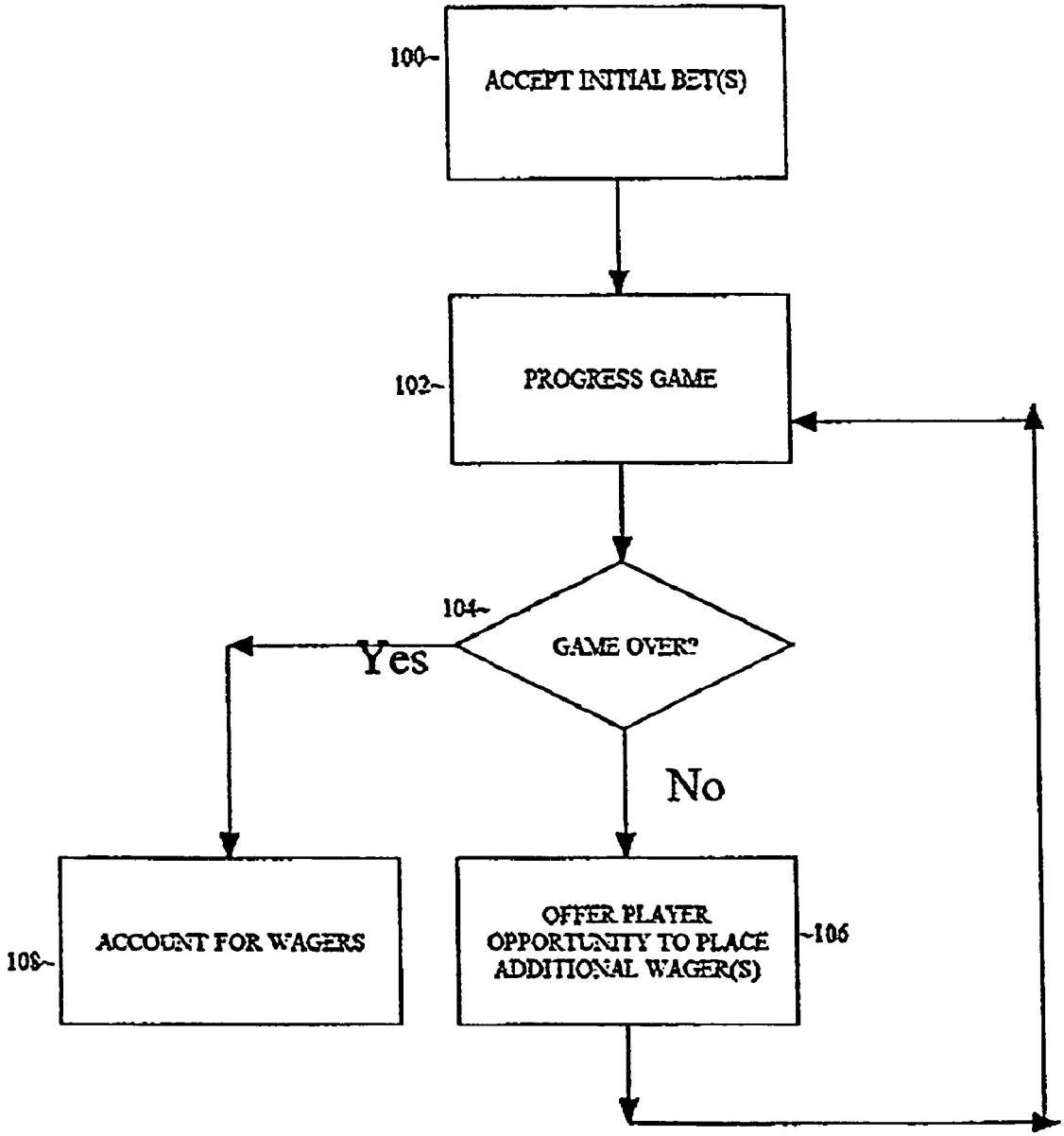
FIG. 1 is a flowchart illustrating one example of a wagering game, according to an embodiment.

Reference will now be made in detail to the presently preferred embodiments of the invention, examples of which are illustrated in the accompanying drawings, wherein like reference numerals refer to like elements throughout.

The present invention relates to casino games with a feature allowing a player to borrow money from the house. The loan is not made in accordance with known procedures for borrowing money in a casino, such as applying for credit and receiving a marker or other cash loan to wager with.

The present invention allows a player to borrow money against the player's position in a game already in progress. Some casino games are over immediately (i.e. "casino war,") in which there is really no "in progress" state. Other games, such as games related to betting on progressions, contain a plurality of game states or intervals upon which a player can develop a "positive position." A game related to betting on a progression can comprise a game which has numerous game states, typically with a preferred outcome. A positive position can comprise a game in a particular game state, with or without particular current wagers made, wherein the player has a better than 100% expected return.

In a first embodiment of the present invention, the player can borrow money from the house when the player is in a positive expectation position.

For example, consider a simple game wherein piece A and piece B start at a beginning square are advanced around a 20 square field according to respective rolls of dice, wherein a winner is the piece which reaches a finish area first. If the first three rolls for piece A are 1,2,1, then piece A would be at square number 4. If the first three rolls for piece B are 5,6,3, then piece B would be at square number 14. Obviously, piece B has a much better chance of winning the game than piece A. If a wager was made on piece B before the race began (assuming each piece pays even money to win), then piece B is considered to have a positive expectation.

A "loan" to the player can be made based on this positive expectation. If the player loses, he typically will not be required to pay the loan back. If the player wins, then the player pays back the loan. However, in exchange for the privilege of taking such a loan out, the player may then also have to pay some type of "interest," commission, vigorish, etc., to the house for the loan.

In an embodiment of the present invention, a player may borrow money from the house if the player is in a positive expectation position and the player makes particular bets wherein the player ensures that he or she is guaranteed to make a profit regardless of an outcome of the game.

For example, consider a bidirectional linear progression game, wherein a piece moves in either of two opposing directions, wherein the game ends when the piece reaches either a leftmost side or a rightmost side. Consider the following exemplary conditions (of course other types of games and conditions can be used besides the one in this example): there are three squares (numbered −1, 0, +1) with finish squares to the very left and right, with one piece moving in either linear direction (left or right) based on a roll of a six sided die (with sides −1, −1, −1, +1, +1, +1, or L, L, L, R, R, R). If the die rolls a −1 (or L), then the piece moves one square to the left. If the die rolls a +1 (or R), then the piece moves one square to the right. When the piece reaches to the finish square left of the leftmost square, or to the finish square to the right of the rightmost square the game is over and either left or right has won. When the piece is on the −1 square, betting on right pays 3:1 and betting on left pays 1:3. When the piece is on the +1 square, betting on right pays 1:3 and betting on left pays 3:1. When the piece is on the 0 square, betting on left or right pays 1:1. Of course the number of squares, parameters of the die, payouts, etc. can be set to whatever the game designer prefers. Further, note that for simplicity this variation has no house edge, although of course a house edge can be worked into the game.

Table I Illustrates an example a game sequence of the above-described game. Each operation can comprise rolling the dice and/or making a wager.

TABLE I

| Operation | Action | Result | Position | Bet Placed | Left Win | Right Win | Exp. Profit |
|---|---|---|---|---|---|---|---|
| 0 | Start | n/a | 0 | n/a | $0 | $0 | $0 |
| 1 | Roll | R | +1 | n/a | $0 | $0 | $0 |
| 2 | Wager | n/a | +1 | $5 left | $15 | −$5 | $0 |
| 3 | Roll | L | 0 | n/a | $15 | −$5 | $5 |
| 4 | RoIl | L | −1 | n/a | $15 | −$5 | $10 |
| 5 | Wager | n/a | −1 | $5 right | $10 | $10 | $10 |
| 6 | Wager | n/a | −1 | $5 right | $5 | $25 | $10 |
| 7 | Wager | n/a | −1 | $5 right | $0 | $40 | $10 |
| 8 | Roll | R | 0 | n/a | $0 | $40 | $20 |
| 9 | Roll | R | +1 | n/a | $0 | $40 | $30 |
| 10 | Roll | R | Right Win | n/a | | | $40 |

In operation #0, the game starts. The puck is placed on the center position position 0). No bets are made yet.

Now the game proceeds to operation 1, which is a roll. The result of the roll is R. Thus the puck is moved 1 square to the right and is now on position +1. No bets have been made, so if right wins or left wins the player wins $0.

The game then proceeds to operation 2, wherein the player makes a wager. The player makes a $5 wager on the leftmost side (although of course the player can choose the amount to wager and the event wagered on). If the leftmost side wins, the player wins $15, while if the rightmost side wins, the player wins −$5 (loses $5). There is no expected profit (or loss) for the player (since this example has no house edge).

The game then proceeds to operation 3, wherein the die is rolled with an outcome of L. Thus, the puck is moved from +1 to 0. Note that the expected profit is now $5, since the puck moved closer to the left which is the outcome that the wager was placed. Thus, the player expectation of this game state is now $5, because in the long run the average amount the player will win is $5. Since this number is positive, the house will lose from this game state in the long run.

The game then proceeds to operation 4, wherein the die is rolled with an outcome of L. The puck moves from 0 to −1. Note that the expected profit is now $10, since the puck has moved closer to the left. This game state is even more favorable to the player and the player's wager than the previous game state.

The game then proceeds to operation 5, wherein the player places a $5 wager on the right. Note that is the puck reaches the leftmost side the player wins $10, and if the puck reaches the rightmost side, the player wins $10. Thus, the player is now in a guaranteed winning situation.

The game then proceeds to operation 6, wherein the player places a $5 wager on the right. Now if the rightmost side wins the player wins $25, while if the leftmost side wins the player wins $5.

The game then proceeds to operation 7, wherein the player places a $5 wager on the right. Now if the rightmost side wins the player wins $40, while if the leftmost side wins the player wins $0 (breaks even from all of the bets).

The game proceeds to operation 8, wherein the die is rolled and the outcome is R. The puck is moved to the right one square to position 0 (the middle). The expected profit is now $20.

The game then proceeds to operation 9, wherein the die is rolled and the outcome is R. The puck is moved to the right one square to position 1. The expected profit is now $30.

The game then proceeds to operation 10, wherein the die is rolled and the outcome is R. The puck is moved one square to the right which places the puck to the right of position 1, which ends the game. The rightmost side has won. The expected profit is now $40, since the player wins a profit of $40 (actually win $60 but has bet $20) and the game is over.

Note that the player has placed $20 in bets (4 bets of $5). However, the player could have started with only $5 in capital, which was wagered in operation 2. Upon reaching operation 5, the house could "lend" the player $5 with which to bet with. This is because the player is putting himself or herself into a guaranteed winning position by making this wager. Upon place the wager in operation 5, the player is guaranteed a net profit $10 regardless of which side wins. Thus, the house can make this "loan" to the player since the house is guaranteed to get paid back once the game is over. Thus, this wager can be made from the player's own funds or from a "loan" from the house—the end result should still be the same.

The same principle applies to the wagers made in operations 6 and 7. The wager in operation 6 results in both outcomes resulting in a profit, thus the house is guaranteed to recoup the loan once the game is over. In operation 7, the player breaks even if the leftmost side wins. Thus, if the leftmost side wins, the player pushes, as whatever he wins from his or her bets on the leftmost side offset the losses from bets on the other side. The house can "lend" the player the money to make the wager in operation 7 because the player is guaranteed to at least break even, thus paying back whatever loan was made.

Therefore, it is noted that according to an embodiment, the player can begin a game with a finite amount of money, and parlay his or her money into an infinite (in theory)

amount of money during the same game. For example, in the above example, if the game did not end in operation 10 but instead the puck traveled back to the left (one or two squares), the player can then make further wagers to increase the amount of his or her win.

In some situations, the player may make a wager which will not put the player into a guaranteed winning situation. However, if the player increases that wager, the player may then put himself into a guaranteed winning situation. For example, in the above example, if the wager in operation 5 is $1 (instead of $5), this would result in a net win of $12 for the leftmost side and a net loss of $2 for the rightmost side. However, if the player wagers $2, then this would result in a net win of $13 for the leftmost side and a net push if the rightmost side wins. Thus, the house may allow the player to make at least a $2 wager in operation 5 (on the rightmost side), since this would result in a no-lose situation for the player (hence the house will always collect the "loan"). But the house may not wish to allow the player to make the $1 wager (unless of course the player is using his or her own money), since there may be a situation where the player will not be guaranteed to pay this loan back.

Thus, the house may wish to compute at what amount a player should make a particular wager in order to be allowed to bet with "borrowed" money. Of course, if the player is not currently in an "equity" state in the game, then no wager (on either side) would put the player into a guaranteed winning situation. An equity state of the game can be considered a position where a player has a positive expectation based on his or her wagers and the game state. A player can "borrow" against this state in order to make further wagers on the game with this borrowed money.

The amount needed to bet in order to put the player into a guaranteed winning position can be computed as follows. First, note that the net win for either or both sides can be computed by the following formulas:

Net left win=(Σleft bet on square n*left payoff for square n)−total bet;

Net right win=(Σright bet on square n*right payoff for square n)−total bet;

If the player wishes to bet on the leftmost side and needs to be in a guaranteed pushing (or winning) position, then the net leftmost win can be set to zero (or greater) and the "left bet on square n" can be solved for, wherein n is the current location of the puck. For example, consider operation 5 of the example above. Suppose it is to be computed how much the player needs to bet to be guaranteed to break even.

Currently, as per the wager in operation 2, the game has one wager of $5 on the leftmost side made at position R. Thus, using the payouts for this particular example as described above, the net left win is: 0*(4/3)+0*(2)+$5*(4)=$15 (note that 1 is added to the payout to account for the return of the original bet, i.e. a 1:3 payout is represented as 4/3 in the above formula). The player wishes to make a bet on the rightmost side in order to guarantee a breakeven situation. Thus, let X=the amount needed to bet to guarantee a breakeven situation. Thus, we set the net right win to be 0 (a push if right wins), such that:

0=0*(4/3)+0*(2)+X*(4)−total amount wagered;

The total amount wagered is going to equal the current amount of bets on the game ($5) plus X. So follows the following equation:

0=X*4−(5+X);

solving for X, we get X=5/3 or $1.67. Thus, the player would need to wager at least $1.67 on the rightmost side in operation 5 in order to break even (or slightly better). This amount can be rounded (up or down) to the closest denomination allowed by the game to be bet.

In an embodiment, an operator may wish to allow the player to wager using borrowed funds only for situations where the player puts himself or herself into a guaranteed winning position. This way the funds are sure to be paid back. In this embodiment, the above formulas/methods can be used to determine when the player will be in a guaranteed winning (or breakeven) position. For example, in one embodiment, money can be loaned to the player as long as both the left net win and the right net win are positive (or at least zero). In this manner, the player cannot lose money on the wager even though the player has borrowed funds in which to do so.

In a further embodiment, the game may automatically compute a wager direction and amount to wager which would guarantee to put the player in a winning (or break even) position, and output this information to the player. For example, in the example above, an optional pop-up window can appear saying, "if you bet $1.67 on the rightmost side, you will be guaranteed not to lose."

Table II below corresponds to the game form Table I and illustrates an example where equity funds are used and the balance between the player's funds (liquid cash present in the machine) and equity funds (funds the player can borrow).

TABLE II

| Operation | Player's funds | Equity funds left side | Equity funds right side |
|---|---|---|---|
| 0-2 | $5 | $0 | $0 |
| 3 | $0 | $0 | $15 |
| 4 | $0 | $0 | $15 |
| 5 | $0 | $0 | $10 |
| 6 | $0 | $0 | $5 |
| 7 | $0 | $0 | $0 |
| 8 | $0 | $40 | $0 |
| 9 | $0 | $40 | $0 |

The player starts with only $5 in credits (e.g. the player deposited a $5 bill in the machine) and places a $5 wager in operation 2. In operation 3, because the puck has moved in the direction of the initial wager (left), the player can now bet $15 on the rightmost side. This is because the player will be guaranteed to win (or at least break even) by now betting on the right side. When the player reaches operation 8, the player can now wager $40 on the left side using equity funds, because the house cannot lose by making this loan.

The player may be given the option of whether to use the player's own funds or borrowed funds for making wagers (if the current circumstances dictate that the player will be allowed to borrow money). Alternatively, the player may be forced to use the player's own liquid funds before having to resort to borrowed funds. Alternatively, the player can automatically use borrowed funds wherever possible before having to use the player's own funds.

In a further embodiment, bets placed using equity funds may pay the player less desirable odds (payouts) for the player than bets placed using the players own funds. For example, an additional commission may be taken out of any win based on equity funds. In an embodiment, a player may be allowed to place a bet with borrowed funds if the player is currently in a positive expectation situation.

Alternatively, an embodiment may allow the player to wager on borrowed funds (on any outcome) without meeting break-even (or profit) requirements. In some cases of betting with borrowed money, the long run distribution of funds at the outcome of the game will be the same or similar whether or not the player makes a wager that does not put him or her into a guaranteed winning position. An example of this is in Table I, operation 5, if the player bet $2.50 instead of $5. Thus, in these situations, the house may permit the player to use borrowed funds to wager into a non-guaranteed winning position.

FIG. 1 is a flowchart illustrating one example of a wagering game, according to an embodiment. A progression game is a game which has a plurality of game states, each game state may have a different expected return for the player based on the player's wagers and the current game state. The game is over when the game reaches a terminating game state.

The method can start at operation 100, which accepts initial bets. A player may not be required to wager on the game before the game starts, and may choose to just wager on the game during the game.

The method can then proceed to operation 102, which progresses the game. This can be accomplished by activating a random number generator in order to change the game state. The game state may also be changed by a player choice (i.e. deciding where to move a piece). A die can be used to move a piece (or pieces) in the game.

The method can then proceed to operation 104, which checks to see if the game is over. The game may be over when variable parts of the game state (i.e. piece positions) are in a terminating condition.

If the check in operation 104 determines that the game is not over, then the method can proceed to operation 106, which offers the player an opportunity to make additional wagers. The method can then return to operation 102, which further progresses the game.

If the check in operation 104 determines that the game is over, then the method can proceed to operation 108, which accounts for wagers. This means taking losing wagers and paying winning wagers according to their respective payouts. Any borrowed money can be repaid at this time. The method may then optionally start a new game and return to operation 100.

As discussed previously, an embodiment allows the player to potentially turn a small or finite amount of money into a large or infinite amount of money by betting with borrowed money based on an equity position in the game.

Figure 2:
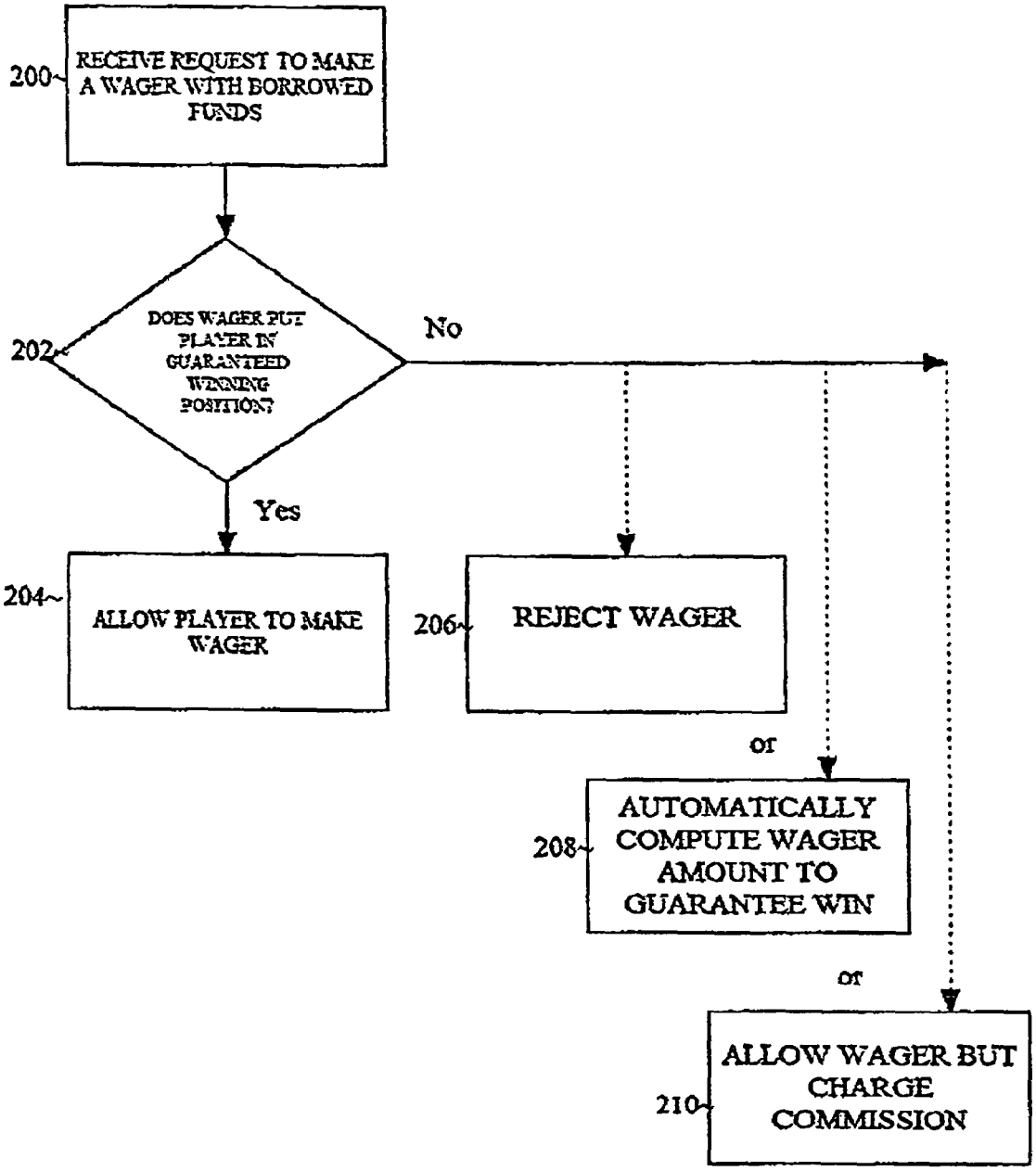
FIG. 2 is a flowchart illustrating one example of borrowing money to pay for a wager, according to an embodiment.

FIG. 2 is a flowchart illustrating one example of borrowing money to pay for a wager, according to an embodiment. The method illustrated in FIG. 2 may occur during operation 106 from FIG. 1.

The method starts with operation 200, which receives a request by a player to make a wager with borrowed funds. The request to use borrowed funds can be explicitly made by the player, or the request can be automatically triggered when a player has no more liquid funds available, or the request can typically be automatically triggered regardless of a player's request of his or her current funds. The borrowed funds can be used from equity (or "equity funds") the player has developed in the current game in progress.

The method then proceeds to operation 202, which determines if the wager will put the player in a guaranteed winning position. This can be done as discussed above, e.g. determining net wins from all possible outcomes and seeing if all net wins result in a positive net win (or at least break even).

If the check in operation 202 determines that the wager puts the player in a guaranteed winning (or at least break even) position, then the method can proceed to operation 204, which allows the player to make the wager. From operation 204, the method can then continue with the game (i.e. proceed to operations 106 or 102).

If the check in operation 202 determines that the wager will not put the player in a guaranteed winning (or break even) position, then the method can proceed to operation 206 which will reject the wager. The player may then try another wager, perhaps a different wager that will not be rejected as such. Otherwise, the game can continue as normal.

Alternatively, if the check in operation 202 determines that the wager will not put the player into a guaranteed winning (or break even) position, then the method can proceed to operation 208, which can automatically compute a wager amount which would put the player in a guaranteed winning (or break even) position. The newly computed wager amount can then be offered to the player for the player's acceptance, or the wager can be made automatically. The computed wager amount can be computed according to the methods described previously. The method can then continue the game.

Alternatively, if the check in operation 202 determines that the wager will not put the player into a guaranteed winning (or break even) position, then the method can proceed to operation 210, which may still allow the wager but charge a commission on the loan. If a player has developed a positive expectation in the current game, then the player may be allowed to borrow against that positive expectation to make a further wager, even if that further wager will not put the player in a guaranteed winning position. It is noted that the house may never receive a payback on this type of loan, for example if the player loses. Typically, the player would not be required to pay such a loan back out of the player's personal funds at a later time. The type of loan for the current game is different from a typical credit loan in which the player must pay back. Thus, in exchange for making the loan to the player in which the house may never get paid back, the house can charge a commission on the loan or can charge an extra commission on any win. In this way, when the game is over, if the result is a net win for the player, the house receives compensation for making the loan. Typically, the average compensation received should offset the potential losses for making this type of loan in the first place.

For example, consider the three square game described earlier. When the puck is on the leftmost square (−1), the player places a $50 wager on the rightmost side. The puck then moves to the rightmost square (+1). The player now has an expected profit of $100. Of course, the player could still lose as well. In an embodiment, the house may choose to loan the player money to make a wager on either side, even though the loan will not put the player in a guaranteed winning position. The "collateral" for the loan is the player's $100 expected profit. The "interest" for such a loan can be a commission taken out of the player's winnings. For example, if the player borrows $10 to now make a bet on the leftmost side, if the puck finishes on the rightmost side the player wins net $140, while if the puck finishes on the leftmost side the player loses $20. A commission can be taken out of the player's winnings (e.g. 20%, or other percentage) to pay for the loan (while if the player loses he does not owe the house money). In this way, the house will still profit from making such loans in the long run. The commission rate should preferably (although not required)

be set so that the commission offsets the house's potential loss on the loan such that the house will make more money from making such loans than not making them. In an embodiment, a commission need not be charged.

Thus, according to embodiments, a player can start with a small amount of money, but continue to make wagers while playing the game allowing the player to build up a large amount of wagers and net wins on the game. The amount of wagers placed can exceed the amount of liquid funds the player currently has. Once the game ends, the player is paid and any "loans" are paid off.

In a further embodiment, the equity concept described herein can be applied to craps. Equity obtained in a game of craps can be cashed in. For example, consider if a player bets an initial don't pass line bet of $100. The outcome of the come out roll is 10 ("the point"). According to the standard rules of craps, if the next roll is 10 the player loses while on a 7 the player wins (any other outcome of the dice results in a re-roll). Since a 7 is more likely than a 10, the player has a positive expectation at this point. If the player wishes to surrender this bet, his surrender value is:

(original bet)+(chance of winning*amount to be won)

In this example, the chance of the player winning in this case is (1/3), while the player will win even money on his or her craps bet of $100. Thus, the value of the player's bet is $100+(1/3)*$100=$133.33. Thus, the player can chooses to continue rolling (and win or lose) or accept the surrender value of $133.33, which is based on equity in his position based on events that have occurred in the game (the come out roll). All other situations in craps can be addressed similarly (i.e. other come out rolls, etc.)

The embodiments described herein can also be used to bet on sporting events, either at intervals on individual games or series of games. For example two teams can play a best 4/7 series. After each game in the series (and even during particular games), payout odds for each team winning the series can change to reflect the current conditions (as described herein and/or known in the art) and players can make wagers during the series.

The embodiments described herein can further be applied to a race game, wherein a player wagers on which of a plurality of pieces will reach a finish line first. For example, a player who wagers on a first piece at the start of the race (in this case where each piece starts at the same position with equal advantage) and the first piece takes the lead, then at that interval the player has developed equity in the game, which can be used as a basis to borrow for further bets. In alternative races, the pieces may not have to start at the same location, and pieces may not all have equal advantage (e.g. different pieces may have different speeds or dies).

The embodiments described herein can further be applied to a chase game, wherein a player wagers on which of one or more pieces will reach a dynamic finish line first. The dynamic finish line is a finish point which can change and can for example be another moving piece.

In addition to applying the equity concepts described herein to the above-described games, the methods described herein of using equity funds can also be used for any game that has variable states and is not over without an interval in between states.

In a further embodiment, implementing a wagering game as described herein can be combined with other gambling games such as craps or roulette. For example, a roulette game can also have a section dedicated to wagering on a bidirectional linear progression (as described herein). When the ball stops on black, a puck can move in one direction (e.g. left), while when the ball stops on red, the puck can move in the opposite direction. In this way, this wagering game can operate alongside a standard roulette game, with no additional random number generator needed. Alternative, the bidirectional linear progression can operate alongside a craps game, using predetermined die or dice outcomes to determine which direction the puck moves.

It is also noted that any and/or all of the above embodiments, configurations, variations of the present invention described above can mixed and matched and used in any combination with one another. Any claim herein can be combined with any others (unless the results are nonsensical). Further, any mathematical formula given above also includes its mathematical equivalents, and also variations thereof such as multiplying any of the individual terms of a formula by a constant(s) or other variable.

Moreover, any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of playing a gambling game between a player and a house, the method comprising:

beginning a wagering game from an initial position;

receiving a first wager from the player on a first outcome of the game;

changing a game state from the initial position to an advanced position based on a first random outcome;

allowing the player to make a second wager on a second outcome of the game using borrowed funds provided by the house if the advanced position is determined to be such that the first wager and the second wager cannot result in a net loss for the player in the game and receiving the second wager from the player using borrowed funds;

completing the game and determining payouts on the first wager and the second wager based on further random outcome(s) of the game; and paying the payouts to the player.

2. A method as recited in claim 1, wherein the random outcome is determined by a die or dice.

3. A method as recited in claim 1, wherein the random outcome is determined by a wheel.

4. A method as recited in claim 1, wherein the random outcome is determined by an electronic random number generator.

5. A method as recited in claim 1, wherein the wagering game comprises a plurality of game states.

6. A method as recited in claim 1, wherein each respective game state comprises a positive or negative expectation depending on wagers made.

7. A method as recited in claim 1, wherein the game is a bidirectional linear progression.

8. A method as recited in claim 1, wherein the game is craps.

9. A method as recited in claim 1, wherein the game is a best of series game.

10. A method as recited in claim 1, wherein the game is a race game.

11. A method as recited in claim 1, wherein the game is a hunt game.

12. A method as recited in claim 1, wherein the game is a chase game.

13. A method as recited in claim 1, wherein placing the second wager by the player puts the player into a guaranteed winning situation.

14. A method as recited in claim 1, further comprising automatically computing a second wager amount for the second wager such that the player will be in a guaranteed winning position.

15. A method as recited in claim 14, further comprising outputting the computed second wager amount to the player.

16. A method as recited in claim 1, further comprising automatically computing a second wager amount for the second wager such that the player will be in a guaranteed break even position.

17. A method as recited in claim 16, further comprising outputting the computed second wager amount to the player.

18. A method as recited in claim 1, wherein if the player borrows money for the second wager, then a payout is paid on the second wager at a lower rate to the player than if non-borrowed funds were used for the second wager.

19. The method as recited in claim 1, wherein the paying repays the borrowed funds before paying winnings to the player.

20. The method as recited in claim 1, wherein upon completing the game, both the first wager and the second wager cannot both be winners.

21. A method of playing a gambling game between a player and a house, the method comprising:

beginning a wagering game from an initial position;

receiving a first wager from the player on a first outcome of the game;

changing a game state from the initial position to an advanced position based on a first random outcome;

allowing the player to make a second wager on a second outcome of the game using borrowed funds provided by the house if the advanced position is determined to be such that the advanced position reflects a positive expectation for the player on the first wager in the game and receiving the second wager from the player using borrowed funds;

completing the game and determining payouts on the first wager and the second wager based on further random outcome(s) of the game; and paying the payouts to the player.

22. A method as recited in claim 21, further comprising charging the player a commission by the house to compensate for the borrowed funds used for the second wager.

23. A method as recited in claim 21, wherein the player is not required to pay back money for the second wager depending on an outcome of the game.

24. A method as recited in claim 21, wherein if the player borrows money for the second wager, then a payout is paid on the second wager at a lower rate to the player than if non-borrowed funds were used for the second wager.

25. The method as recited in claim 21, wherein the paying repays the borrowed funds before paying winnings to the player.

26. A method of playing a gambling game between a player and a house, the method comprising:

beginning a wagering game from an initial position;

receiving a first wager from the player on a first outcome of the game;

changing a game state from the initial position to an advanced position based on a first random outcome;

allowing the player to make a second wager on a second outcome of the game using borrowed funds provided by the house if the advanced position is determined to be such that the advanced position reflects a guaranteed winning situation for the player in the game if the second wager is placed and receiving the second wager from the player using borrowed funds;

completing the game and determining payouts on the first wager and the second wager based on further random outcome(s) of the game; and paying the payouts to the player.

27. A method as recited in claim 26, wherein if the player borrows money for the second wager, then a payout is paid on the second wager at a lower rate to the player than if non-borrowed funds were used for the second wager.

28. The method as recited in claim 26, wherein the paying repays the borrowed funds before paying winnings to the player.

29. The method as recited in claim 26, wherein upon completing the game, both the first wager and the second wager cannot both be winners.

* * * * *